US008757934B2

(12) United States Patent
Hall et al.

(10) Patent No.: US 8,757,934 B2
(45) Date of Patent: Jun. 24, 2014

(54) FULLY GROUTED CABLE BOLT

(75) Inventors: James D. Hall, Benwood, WV (US); Fred Stafford, New Cumberland, WV (US); John G. Oldsen, Butler, PA (US); Dakota Faulkner, New Kensington, PA (US)

(73) Assignee: FCI Holdings Delaware, Inc., Wilmington, DE (US)

( * ) Notice: Subject to any disclaimer, the term of this patent is extended or adjusted under 35 U.S.C. 154(b) by 0 days.

(21) Appl. No.: 13/206,881

(22) Filed: Aug. 10, 2011

(65) Prior Publication Data

US 2012/0039672 A1 Feb. 16, 2012

Related U.S. Application Data

(60) Provisional application No. 61/372,210, filed on Aug. 10, 2010.

(51) Int. Cl.

| | |
|---|---|
| ***E21D 20/00*** | (2006.01) |
| ***E21D 20/02*** | (2006.01) |
| *E21D 21/00* | (2006.01) |

(52) U.S. Cl.

CPC ..... *E21D 20/028* (2013.01); *E21D 2021/006* (2013.01)

USPC ..... 405/259.1; 405/259.5; 405/288; 405/302.2

(58) Field of Classification Search

USPC ..... 405/259.1, 259.5, 259.6, 288, 302.1, 405/302.2

See application file for complete search history.

(56) References Cited

U.S. PATENT DOCUMENTS

| | | | | | |
|---|---|---|---|---|---|
| 3,820,832 | A | * | 6/1974 | Brandestini et al. | 24/115 A |
| 4,158,519 | A | * | 6/1979 | Gamlin | 405/259.5 |
| 4,449,855 | A | * | 5/1984 | Langwadt | 405/259.5 |
| 4,765,778 | A | * | 8/1988 | Valentine | 405/259.5 |
| 5,181,800 | A | * | 1/1993 | Stankus et al. | 405/259.6 |
| 5,342,149 | A | * | 8/1994 | McCabe et al. | 405/269 |
| 5,344,195 | A | * | 9/1994 | Parimore et al. | 285/91 |
| 5,375,947 | A | * | 12/1994 | Gouws et al. | 405/259.5 |
| 5,378,087 | A | * | 1/1995 | Locotos | 405/259.5 |
| 5,511,909 | A | * | 4/1996 | Calandra et al. | 405/259.6 |
| 5,525,013 | A | * | 6/1996 | Seegmiller et al. | 405/259.3 |
| 5,647,694 | A | * | 7/1997 | Locotos | 405/259.4 |
| 5,749,681 | A | * | 5/1998 | Doidge et al. | 405/302.2 |
| 5,785,463 | A | | 7/1998 | Eaton et al. | |
| 5,791,824 | A | * | 8/1998 | Radtke | 405/259.5 |
| 5,829,922 | A | | 11/1998 | Calandra, Jr. et al. | |
| 5,919,006 | A | | 7/1999 | Calandra, Jr. et al. | |
| 5,954,455 | A | | 9/1999 | Eaton et al. | |

(Continued)

FOREIGN PATENT DOCUMENTS

| | | | | | |
|---|---|---|---|---|---|
| JP | 2003314199 | A | * | 11/2003 | E21D 20/00 |
| WO | WO 2010019971 | A1 | * | 2/2010 | E21D 21/00 |
| WO | WO 2010059168 | A1 | * | 5/2010 | E21D 20/02 |
| WO | 2010072000 | A1 | | 7/2010 | |

*Primary Examiner* — Thomas B Will
*Assistant Examiner* — Jessica H Lutz
(74) *Attorney, Agent, or Firm* — The Webb Law Firm

(57) ABSTRACT

A cable bolt includes a cable having a first end and a second end, and a barrel and wedge assembly attached to the cable at a position adjacent to the first end of the cable. The barrel and wedge assembly has a first end and a second end. The cable bolt also includes a nut positioned adjacent to the first end of the barrel and wedge assembly and defines a sealed interface therebetween. The nut defines a passageway in fluid communication with the cable.

21 Claims, 7 Drawing Sheets

(56) References Cited

U.S. PATENT DOCUMENTS

| | | | | |
|---|---|---|---|---|
| 6,074,134 | A | 6/2000 | Stankus et al. | |
| 6,270,290 | B1 * | 8/2001 | Stankus et al. | 405/259.6 |
| 6,322,290 | B1 * | 11/2001 | Calandra et al. | 405/259.1 |
| 6,428,243 | B1 * | 8/2002 | Hutchins | 405/259.1 |
| 6,612,783 | B2 * | 9/2003 | Stankus et al. | 405/259.5 |
| 6,684,585 | B2 * | 2/2004 | Campbell | 52/223.13 |
| 6,932,543 | B2 * | 8/2005 | Kim | 405/259.4 |
| 7,381,013 | B1 * | 6/2008 | Rataj et al. | 405/259.5 |
| 7,465,128 | B2 * | 12/2008 | Bruneau | 405/259.3 |
| 7,588,394 | B1 * | 9/2009 | Walker et al. | 405/302.2 |
| 8,033,760 | B2 * | 10/2011 | Hinton et al. | 405/302.2 |
| 8,251,617 | B2 * | 8/2012 | Leppanen | 405/302.2 |
| 2002/0057948 | A1 * | 5/2002 | Roald et al. | 405/266 |
| 2005/0158127 | A1 * | 7/2005 | Fergusson | 405/259.5 |
| 2006/0093438 | A1 * | 5/2006 | Fergusson | 405/259.3 |
| 2007/0009330 | A1 | 1/2007 | Locotos | |
| 2009/0067932 | A1 * | 3/2009 | Fox | 405/302.2 |
| 2009/0191007 | A1 | 7/2009 | Seegmiller | |
| 2011/0217126 | A1 * | 9/2011 | Oldsen et al. | 405/259.4 |

* cited by examiner

FULLY GROUTED CABLE BOLT

CROSS REFERENCE TO RELATED APPLICATIONS

This application claims the benefit of U.S. Provisional Application No. 61/372,210, filed Aug. 10, 2010, the entire content of which is hereby incorporated by reference.

BACKGROUND OF THE INVENTION

1. Field of the Invention

The present invention relates to fully grouted cable bolts, in particular, a cable bolt which is adapted to receive grout through the cable and be anchored in a mine roof borehole.

2. Description of Related Art

Cable bolts are used in the mining industry for their ease of handling and installation. Cable bolts are substantially easier to fit into a borehole than the elongated rods of conventional rod bolt systems. Regardless of the height limitations in a mine, cable bolts may be adapted to boreholes of any length due to their flexibility. The strength capacity of cables exceeds that of conventional rod bolts and, therefore, cable is the preferred reinforcement for certain roof conditions.

Cable bolts are typically installed by placing a resin cartridge including catalyst and adhesive material into the blind end of a borehole, inserting the cable bolt into the borehole so that the upper end of the cable bolt rips open the resin cartridge and the resin flows in the annulus between the borehole and the cable bolt, rotating the cable bolt to mix the resin catalyst and adhesive, and allowing the resin to set about the cable bolt. In such cable bolts, the resin is typically set at an upper portion of the cable bolt at the blind end of the borehole.

In certain installations of mine roof bolts, it may be desirable to fully grout the entire length of the bolt that is received within the borehole so as to provide extended corrosion protection and/or enhanced anchorage in the surrounding rock strata.

SUMMARY OF THE INVENTION

In one embodiment, a cable bolt includes a cable having a first end and a second end, and a barrel and wedge assembly attached to the cable at a position adjacent to the first end of the cable. The barrel and wedge assembly have a first end and a second end. The cable bolt also includes a nut positioned adjacent to the first end of the barrel and wedge assembly and defines a sealed interface therebetween. The nut defines a passageway in fluid communication with the cable.

The cable bolt may further include a stiffener having a first end and a second end that receives a portion of the cable with the stiffener positioned adjacent to the second end of the barrel and wedge assembly and defining a sealed interface therebetween. The cable may be a multi-strand cable, and strands of the multi-strand cable may define a plurality of gaps. A first o-ring may be positioned between the nut and the first end of the barrel and wedge assembly, and a second o-ring may be positioned between the stiffener and the second end of the barrel and wedge assembly. A weld may secure the nut to the first end of the barrel and wedge assembly with the weld extending circumferentially around the nut. The barrel and wedge assembly may include a housing defining a passageway and wedges positioned within the passageway, and the stiffener may have a threaded portion that is received by a corresponding threaded portion of the housing. An exterior surface of the housing of the barrel and wedge assembly may define an annular groove. The nut may include a body having a flange extending radially outward from the body and the passageway of the nut may extend through the body. The nut may include a threaded portion positioned within the passageway of the nut.

The cable bolt may also include a ring that is positioned over the stiffener and the cable with the ring secured to the second end of the barrel and wedge assembly and defining an annular groove. The annular groove of the ring receives an O-ring that engages the stiffener. A washer and a tube may be positioned over the stiffener and the cable with the washer and the tube configured to restrict the flow of grout within a borehole upon installation. The cable bolt may also include an expansion assembly having expansion anchors and an expansion plug with the expansion assembly received on a threaded portion of the stiffener. A bearing plate may be positioned between the barrel and wedge assembly and the tube.

In a further embodiment, a method of installing a cable bolt includes inserting a cable bolt into a borehole. The cable bolt includes a multi-strand cable, a barrel and wedge assembly, and a nut defining a passageway. The multi-strand cable defines a plurality of gaps between strands of the cable. The method further includes delivering grout to the passageway of the nut, through the plurality of gaps between the strands of the cable, and into the borehole.

The method may further include rotating the cable bolt to expand an expansion assembly provided on the cable bolt such that the expansion assembly engages rock strata adjacent to the borehole. The grout may be a polyurethane resin. The method may also include injecting the grout into cracks in rock strata that are adjacent to the borehole. The grout may be delivered at a pressure of at least about 4,000 psi.

DESCRIPTION OF THE PREFERRED EMBODIMENTS

Figure 1:
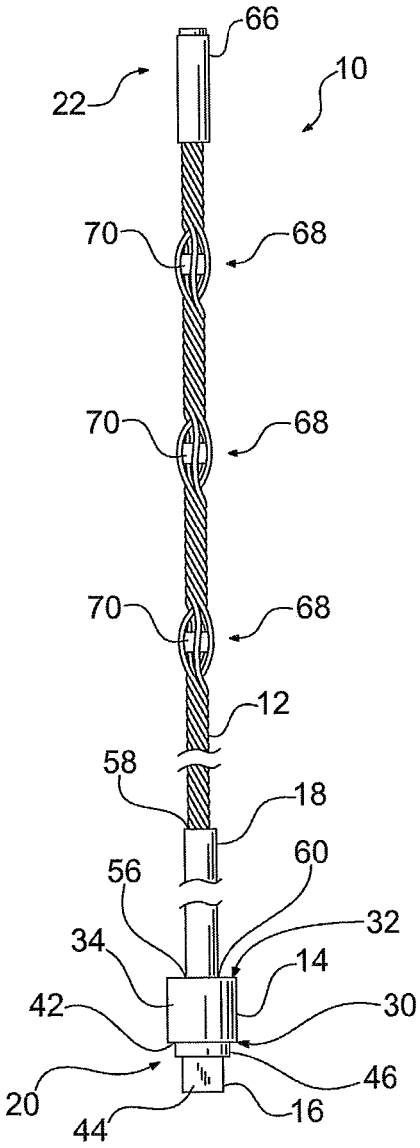
FIG. 1 is a side elevational view of a cable bolt according to one embodiment of the present invention.

For purposes of the description hereinafter, the terms "upper", "lower", "right", "left", "vertical", "horizontal", "top", "bottom", and derivatives thereof, shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

Figure 2:
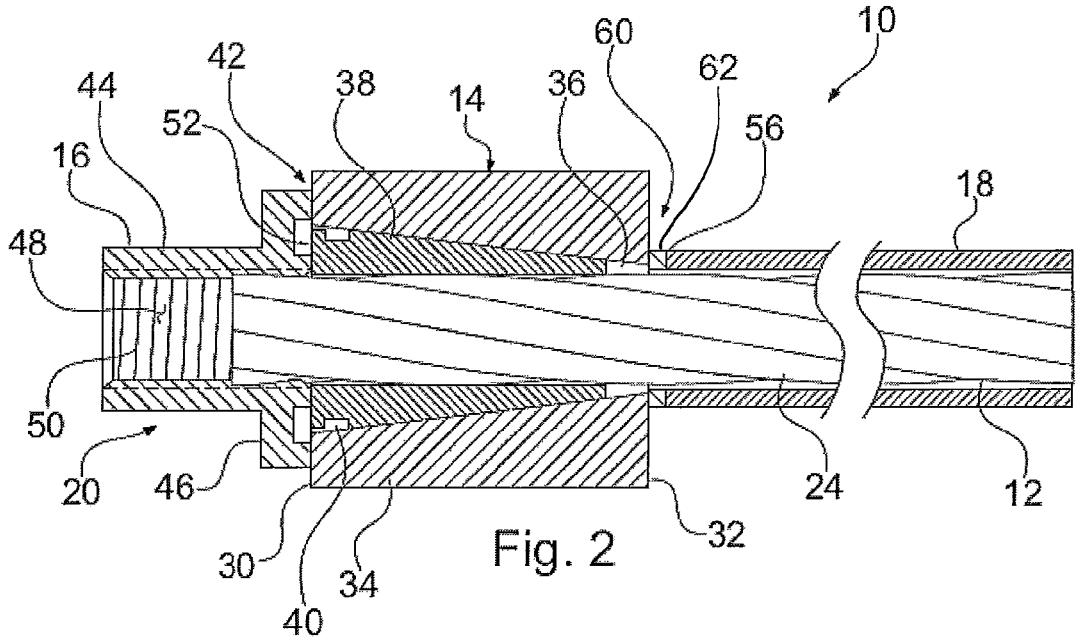
FIG. 2 is a partial cross-sectional view of a first end of the cable bolt of FIG. 1.
Figure 3:
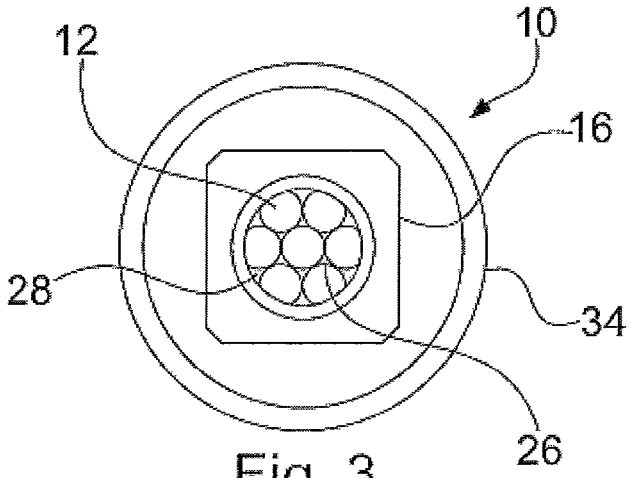
FIG. 3 is a plan view of a first end of the cable bolt shown in FIG. 1.

Referring to FIGS. 1-3, one embodiment of a cable bolt 10 includes a multi-strand cable 12, a barrel and wedge assembly 14, a nut 16, and a stiffener 18. The cable 12 includes a first end 20 and a second end 22 and may be a seven-strand type which has a center strand enclosed by six helically wound outer strands with a uniform pitch of between twelve and sixteen times the nominal diameter of the cable, which may be 0.7 inch. Strands 24 of the multi-strand cable 12 define a plurality of gaps 26. A gap 28 is also defined between the outside of the cable 12 and the nut 16, the barrel and wedge assembly 14, and the stiffener 18. The barrel and wedge assembly 14 is attached to the cable 12 at a position adjacent to the first end 20 of the cable 12. The barrel and wedge assembly 14 has a first end 30 and a second end 32 and includes a housing 34 that is generally cylindrical. The housing 34 of the barrel and wedge assembly 14 defines a passageway 36 that receives a plurality of wedges 38. The barrel and wedge assembly 14 is a well-known arrangement for receiving the loading requirements of a cable bolt. The plurality of wedges 38 may be a two-piece or three-piece arrangement. Prior to installation, the wedges 38 may at least initially be held together with a band (not shown) received within grooves 40.

The nut 16 is positioned adjacent to the first end 30 of the barrel and wedge assembly 14 and defines a sealed interface 42 between the nut 16 and the barrel and wedge assembly 14. The nut 16 includes a body 44 having a flange 46 extending radially outward from the body 44. The body 44 of the nut 16 defines a passageway 48 extending through the body 44 in a longitudinal direction thereof. The passageway 48 of the nut 16 receives the first end 20 of the cable 12 and is in fluid communication with the gaps 26, 28. The nut 16 may be secured to the first end 20 of the cable 12 such as by crimping the nut 16 onto the cable 12 or through any other suitable fastening arrangement. The nut 16 also includes an internally threaded portion 50. In particular, the threaded portion 50 is provided on the body 44 of the nut 16 within the passageway 48 and is adapted to receive a correspondingly threaded portion of a fitting for introducing grout (not shown). The exterior surface of the nut 16 may be polygonal (four-sided or six-sided) or the like so as to be receivable by conventional mine roof bolt installation equipment (not shown). Further, an o-ring (not shown) may be positioned at 52 between the nut 16 and the first end 30 of the barrel and wedge assembly 14 or the nut 16 may be welded to the barrel and wedge assembly 14 to provide the sealed interface 42 between the nut 16 and the housing 34 of the barrel and wedge assembly 14. The O-ring may be provided in a groove defined by the housing 34 or nut 16 or, alternatively, may be sandwiched between the nut 16 and the housing 34.

Referring again to FIGS. 1-3, the stiffener 18 is generally tube-shaped and has a first end 56 and a second end 58. The stiffener 18 is positioned over and receives a portion of the cable 12. The first end 56 of the stiffener 18 is positioned adjacent to the second end 32 of the barrel and wedge assembly 14 and defines a sealed interface 60 therebetween. The stiffener 18 may be crimped to the cable 12 at one or more positions along the length of the stiffener 18. As shown in FIG. 2, an O-ring (not shown) may be positioned at 62 between the first end 56 of the stiffener 18 and the second end 32 of the barrel and wedge assembly 14 to provide the sealed interface 60 between the stiffener 18 and the housing 34 of the barrel and wedge assembly 14. The O-ring may be provided in a groove defined by the housing 34 or stiffener 18 or, alternatively, may be sandwiched between the stiffener 18 and the housing 34. Rather than providing an O-ring, the first end 56 of the stiffener 18 may be welded to the housing 34 of the barrel and wedge assembly 14 to provide the sealed interface 60 therebetween.

Referring to FIG. 1, the cable bolt 10 also includes an end button 66 that secures the free ends of the strands 24 of the cable 12 and birdcages 68 with nuts or buttons 70 received on the center wire, as are all known in the art. The cable bolt 10 may also include a plurality of buttons (not shown) surrounding and attached to the cable 12 at various points along the length of the cable 12. The provision of birdcages 68 or other mixing devices improves mixing of grout during installation, as well as increasing the bond strength of the grout to the cable bolt 10. The cable bolt 10, however, may have no mixing devices and the cable 12 may be free of protrusions or disturbances along the length of the cable 12.

Figure 4:
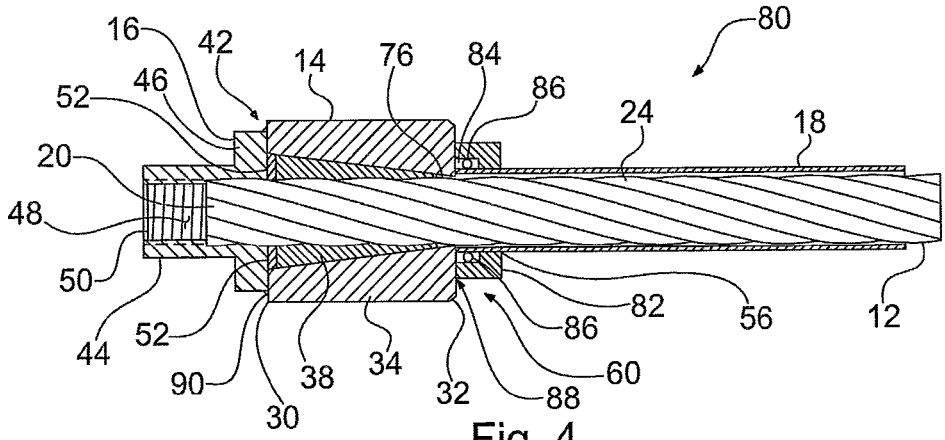
FIG. 4 is a partial cross-sectional view of a first end of a cable bolt according to a further embodiment of the present invention.

Referring to FIG. 4, a further embodiment of a cable bolt 80 is disclosed. The cable bolt 80 is similar to the cable bolt 10 shown in FIGS. 1-3 and described above. The cable bolt 80 includes a ring 82 that is positioned over the stiffener 18 and cable 12. The ring 82 surrounds the stiffener 18 and defines an annular groove 84 for receiving an O-ring 86 that engages and seals the ring 82 to the stiffener 18. A weld bead 88 is provided at the interface between the ring 82 and the housing 34. This arrangement further prevents leakage of grout between the housing 34 and stiffener 18, as well as to prevent an airlock between the first and second ends 20, 22 of the cable 12 during installation. Further, the nut 16 may also be welded to the first end 30 of the barrel and wedge assembly 14 with a weld bead 90 extending circumferentially around the nut 16 to provide the sealed interface 42 between the nut 16 and the barrel and wedge assembly 14. The O-ring positioned at 52 may be omitted when the nut 16 is welded to the barrel and wedge assembly 14.

Figure 5:
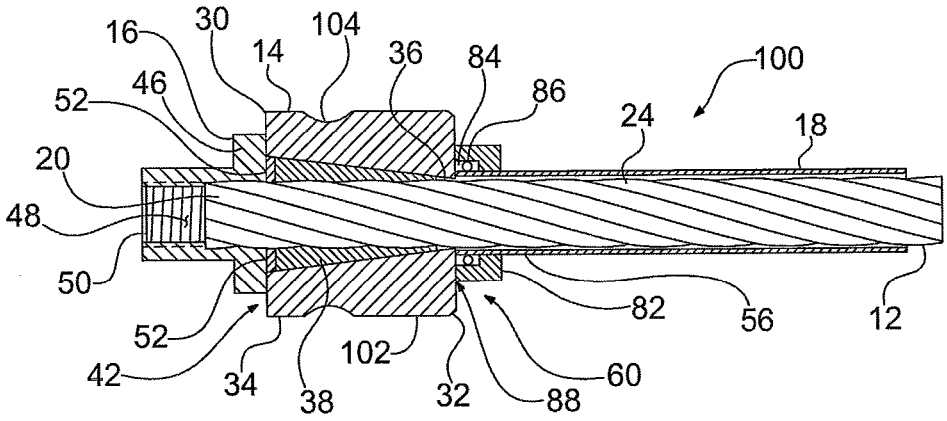
FIG. 5 is a partial cross-sectional view of a first end of a cable bolt according to another embodiment of the present invention.

Referring to FIG. 5, another embodiment of a cable bolt 100 is disclosed. The cable bolt 100 is similar to the cable bolt 80 shown in FIG. 4 and described above. The housing 34 of the barrel and wedge assembly 14 of the present embodiment, however, includes an exterior surface 102 that defines an annular groove 104 for receiving a cam lock fitting of a cam and groove hose coupling (not shown) that is connected to a source of grout. The housing 34 may generally be larger in overall diameter and have a greater wall thickness than the housing 34 shown in FIGS. 1-4.

Figure 6:
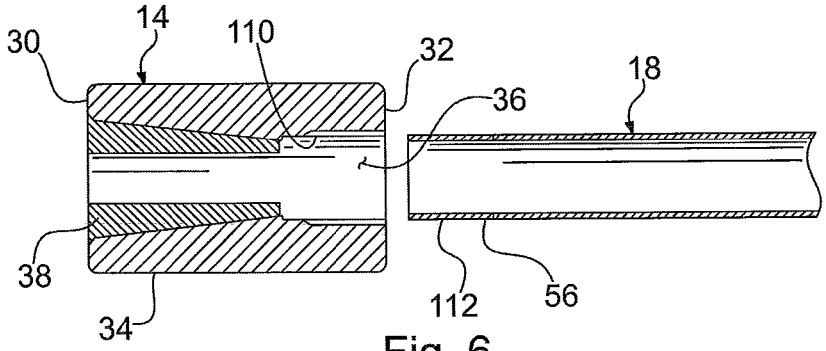
FIG. 6 is a partial cross-sectional view of a first end of a cable bolt according to yet another embodiment of the present invention.

Referring to FIG. 6, an alternative embodiment of the barrel and wedge assembly 34 and stiffener 18 is disclosed. Rather than welding the housing 34 of the barrel and wedge assembly 14 to the stiffener 18 or providing the O-ring at 62 between the housing 34 and the stiffener 18, the housing 34 is provided with a threaded portion 110 within the passageway 36 and the stiffener 18 is provided with a correspondingly threaded portion 112 adjacent to the first end 56 of the stiffener 18. The stiffener 18 is threaded into the housing 34 and provides the sealed interface 60 between the stiffener 18 and the barrel and wedge assembly 14. A thread sealant (not shown) may be provided at the respective threaded portions 110, 112.

Figure 7:
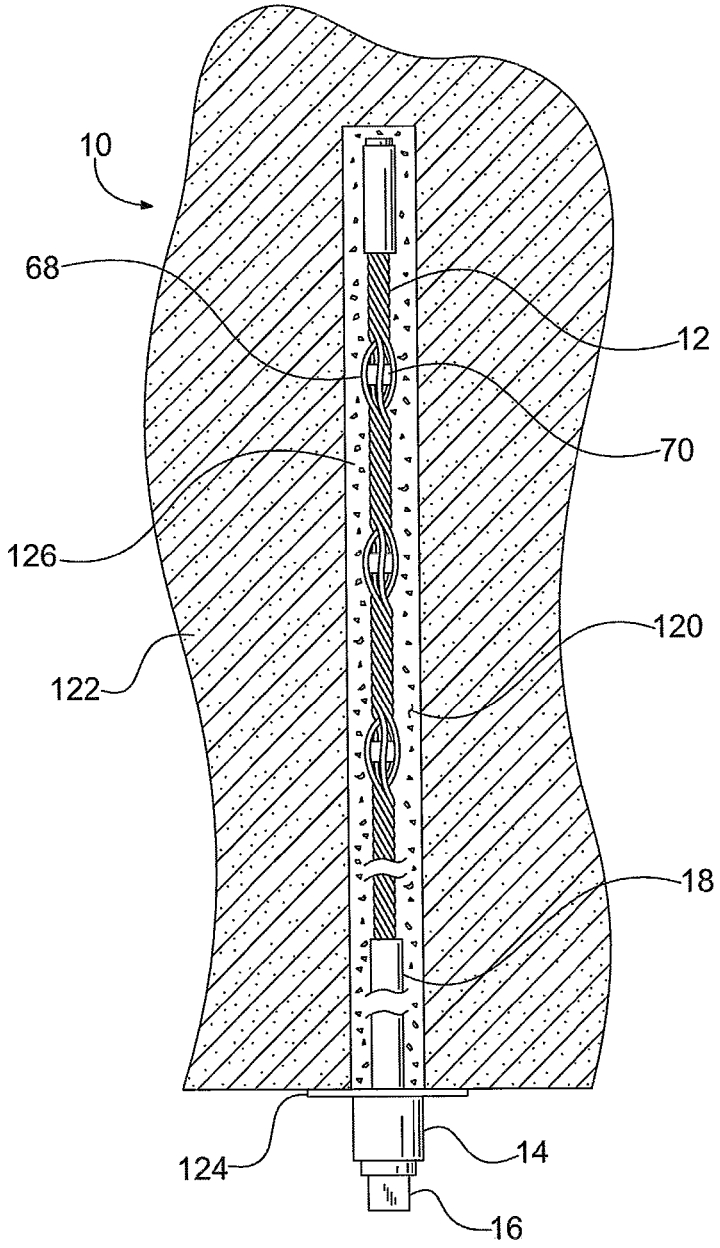
FIG. 7 is a side elevational view of the cable bolt of FIG. 1, showing the installation of the cable bolt.

Referring to FIG. 7, upon installation, the cable bolt 10 shown in FIGS. 1-3 is inserted into a borehole 120 of a rock formation 122 to support the rock formation 122, such as a mine roof or rib. The cable bolt 10 is installed with a bearing plate 124, such as a volcano plate, a flat plate, a channel plate, or any other suitable plate. Grout 126 is delivered to the passageway 48 of the nut 16 to the underside of the cable 12. The grout 126 flows through the plurality of gaps 26 between the strands 24 of the cable 12 and the gap 28 that extends between the outside of the cable 12, the housing 34 of the barrel and wedge assembly 14, the body 44 of the nut 16, and the stiffener 18. The sealed interfaces 42, 60 between the nut 16 and the barrel and wedge assembly 14 and between the stiffener 18 and the barrel and wedge assembly 14 prevent the grout 126 from flowing out between the nut 16 and the barrel and wedge assembly 14 and between the stiffener 18 and the barrel and wedge assembly 14. As grout 126 continues to be delivered into the nut 16 and to the underside of the cable 12, the grout 126 flows up through the cable 12 and along the exterior surfaces of the cable 12 to substantially fill all of the gaps 26, 28 within the cable 12 as well as to fill the borehole 120. The grout 126 may be delivered via a pump (not shown) having a pressure gauge. When a spike in the pump pressure is achieved, it is presumed that all of the gaps 26, 28 and the borehole 120 are substantially filled and grout delivery may be ceased. The grout 126 cures or solidifies, resulting in a column of grout surrounding and filling the cable bolt 10 anchored within the borehole 120.

Suitable grout 126 for use in the present invention is polyurethane resin, which is produced in situ from a polyol component and an isocyanate component. Such two-component polyurethane is used in underground mines for sealing cracks and the like, as provided by Weber Mining. The components are maintained in separate containers prior to use and may be delivered into a single stream via in-line mixer for delivery into the nut. The components are further mixed as they flow within and along the cable.

The cable bolts 80, 100 shown in FIGS. 4-6 may be installed in a similar manner as described above in connection with the cable bolt 10 shown in FIGS. 1-3. The cable bolts 10, 80, 100 of the present invention are particularly suited for use in long term installations, e.g., main mine entries. The cable bolts 10, 80, 100 are "fully grouted", which means that substantially the entire length of the cable bolts 10, 80, 100 are encased in grout 126 upon completion of installation thereof in a borehole. The full column of grout surrounding the cable bolt provides protection from corrosion in the harsh underground environment. The fully grouted cable bolts 10, 80, 100 also provide enhanced anchorage compared to cable bolts that are not fully grouted. The column of grout surrounding the cable bolts 10, 80, 100 further reinforces the rock strata 122.

Figure 8:
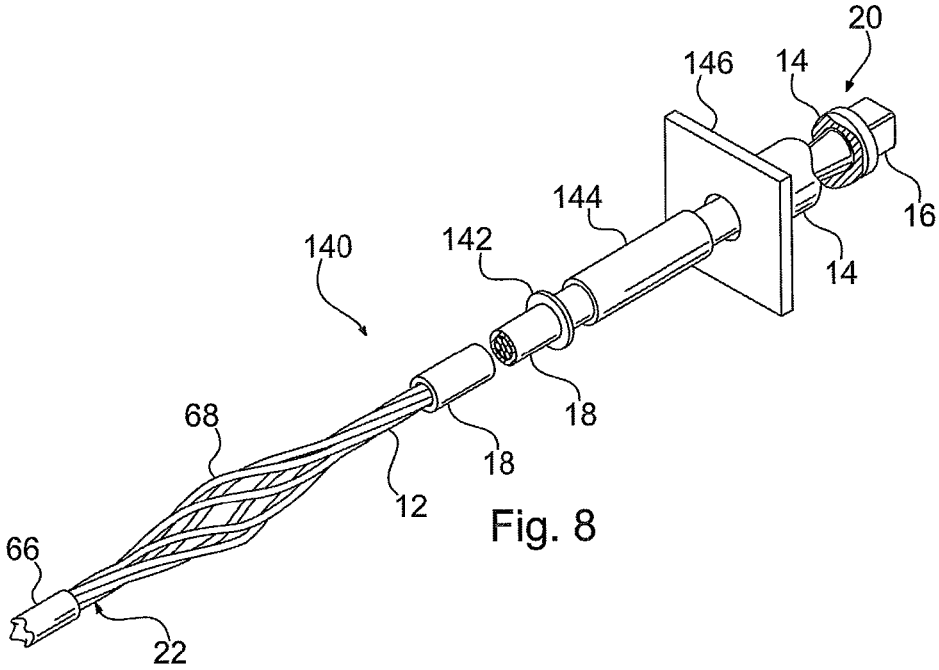
FIG. 8 is a perspective view of a cable bolt according to a further embodiment of the present invention.
Figure 9:
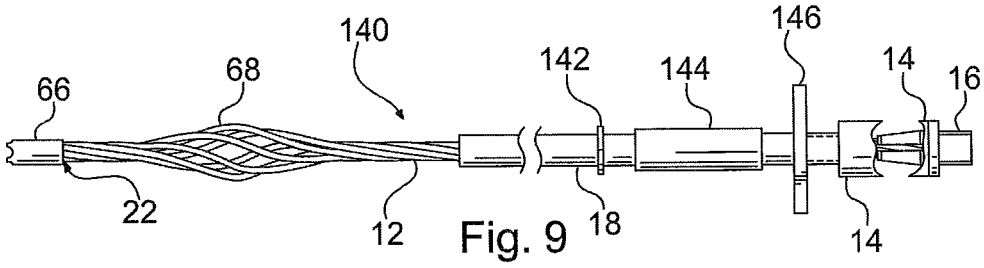
FIG. 9 is a side elevational view of the cable bolt of FIG. 8.

Referring to FIGS. 8 and 9, yet another embodiment of a cable bolt 140 is disclosed. The cable bolt 140 is similar to the cable bolts 10, 80, 100 shown in FIGS. 1-7. The cable bolt 140 of the present embodiment, however, further includes a washer 142 and a tube 144 positioned over the stiffener 18 and cable 12. The stiffener 18 and cable 12 extend through the washer 142 and tube 144, which circumferentially surround the stiffener 18. The washer 142 may be constructed of rubber, although any other suitable material may be utilized for the washer 142. The tube 144 may be constructed of plastic, although any other suitable material may be utilized for the tube 144. The washer 142 and tube 144 are positioned intermediate the first and second ends 20, 22 of the cable 12. Further, a bearing plate 146 is positioned between the barrel and wedge assembly 14 and the tube 144. The washer 142 and tube 144 are configured to restrict the flow of grout within a borehole upon installation of the cable bolt 140.

Figure 10:
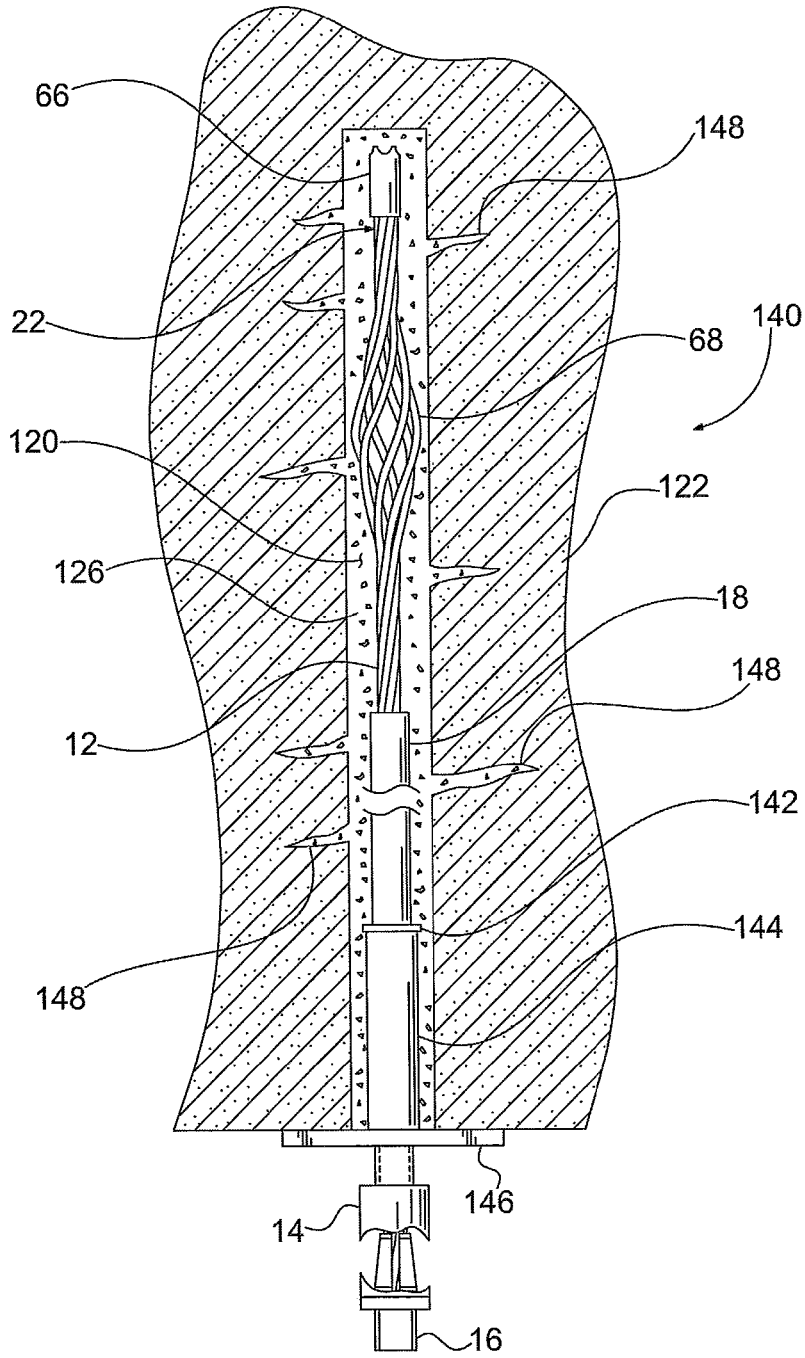
FIG. 10 is a side elevational view of the cable bolt of FIG. 8, showing the installation of the cable bolt.

Referring to FIG. 10, the cable bolt 140 is installed in the same manner as described above in connection with the cable bolt 10 shown in FIGS. 1-3. The grout 126, however, is injected into the rock strata 122 adjacent to the borehole 120 by delivering the grout 126 at higher pressures. In particular, the grout 126 is delivered at a pressure of at least above 4,000 psi, i.e., equal to or greater than approximately 4,000 psi. Delivering the grout 126 at such pressure causes the grout 126 to be injected or forced into cracks or fissures 148 in the rock strata 122 adjacent to the borehole 120, which consolidates the rock strata 122 into one solid mass. The flow of the grout 126 is slowed by the washer 142 and tube 144, described above, which creates a plug between the stiffener 18 and the rock strata 122 adjacent to the borehole 120 once the grout 126 sets. The washer 142 and tube 144 allow the high pressures to be obtained during installation.

Figure 11:
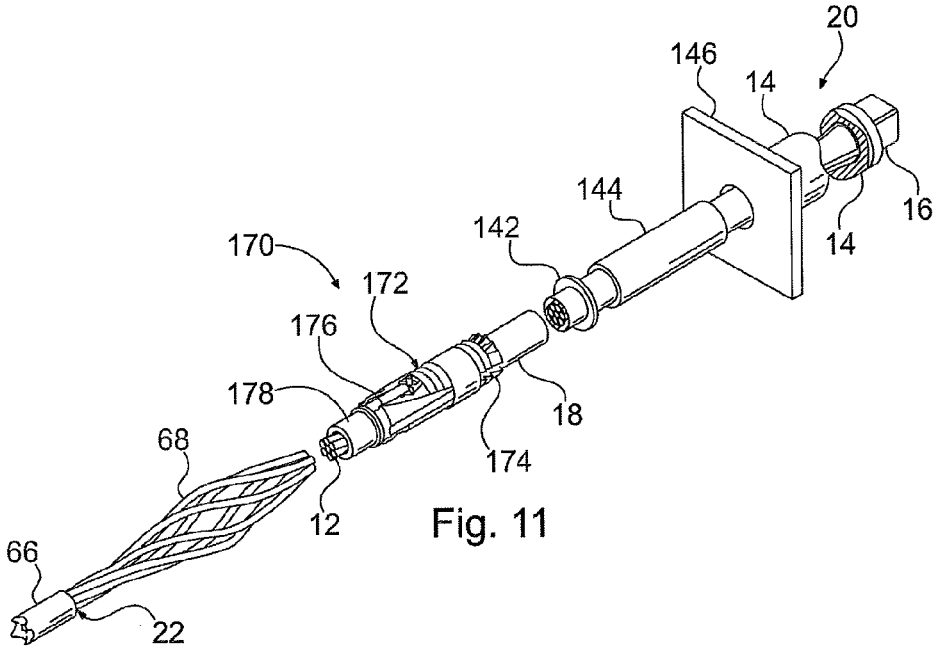
FIG. 11 is a perspective view of a cable bolt according to yet another embodiment of the present invention.
Figure 12:
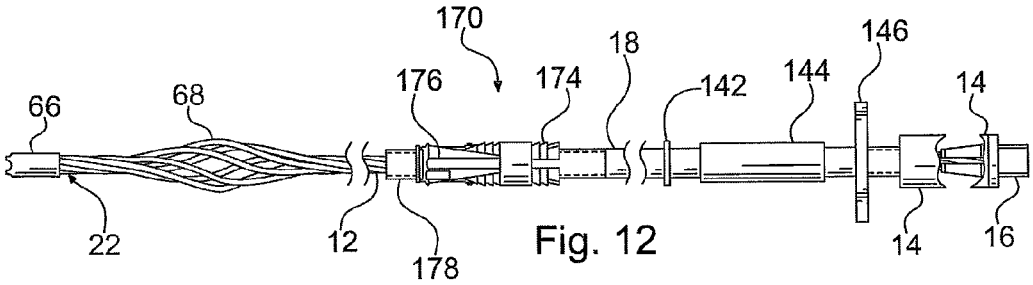
FIG. 12 is a side elevational view of the cable bolt shown in FIG. 11.

Referring to FIGS. 11 and 12, yet a further embodiment of a cable bolt 170 is disclosed. The cable bolt 170 is similar to the cable bolt 140 shown in FIGS. 8-10. The cable bolt 170 of the present embodiment, however, further includes an expansion assembly 172 having expansion anchors 174 and an expansion plug 176. The expansion assembly 172 may be a bail-type expansion assembly as generally known in the art. The expansion assembly 172 is received on a threaded portion 178 of the stiffener 18. In particular, the expansion plug 176 may be threaded onto the stiffener 18. The expansion anchors 174 are configured to expand upon insertion of the cable bolt 170 into a borehole and subsequent rotation of the cable bolt 170. The cable bolt 170 may be installed in the same manner as described above in connection with the cable bolt 140 shown in FIGS. 8-10. However, prior to delivering the grout 126, the cable bolt 170 is rotated to expand the expansion anchors 174 such that the anchors 174 engage the rock strata 122 adjacent to the borehole 120. The cable bolt 170 may be rotated via the nut 16.

Although the invention has been described in detail for the purpose of illustration based on what is currently considered to be the most practical and preferred embodiments, it is to be understood that such detail is solely for that purpose and that the invention is not limited to the disclosed embodiments but, on the contrary, is intended to cover modifications and equivalent arrangements that are within the spirit and scope of the description. For example, it is to be understood that the present invention contemplates that, to the extent possible, one or more features of any embodiment can be combined with one or more features of any other embodiment.

The invention claimed is:

1. A cable bolt comprising:

a cable having a first end and a second end, the cable comprising a multi-strand cable comprising a center strand and outer strands each having an end face at the first end, the multi-strand cable defining a plurality of gaps between the center strand and outer strands;

a barrel and wedge assembly attached to the cable at a position adjacent to the first end of the cable, the barrel and wedge assembly comprising a housing defining a passageway and a plurality of wedges at least partially positioned within the passageway, the housing having a first end and a second end positioned opposite the first end; and a nut secured to and positioned adjacent to the first end of the housing and defining a sealed interface therebetween, the nut defining a passageway in fluid communication with the cable, the first end of the cable received within a first end of the passageway of the nut, a second end of the passageway configured to receive a fitting for introducing grout, the nut secured to the cable such that each of the plurality of gaps between the end faces at the first end of the cable remain open for receiving grout therethrough, the sealed interface configured to prevent grout from passing through the sealed interface when grout is delivered through the passageway of the nut and the passageway of the housing under pressure.

2. The cable bolt of claim 1, further comprising a stiffener having a first end and a second end that receives a portion of the cable, the stiffener positioned adjacent to the second end of the housing and defining a sealed interface therebetween.

3. The cable bolt of claim 2, wherein a first o-ring is positioned between the nut and the first end of the housing, and a second o-ring is positioned between the stiffener and the second end of the housing.

4. The cable bolt of claim 1, wherein a weld secures the nut to the first end of the housing, the weld extending circumferentially around the nut.

5. The cable bolt of claim 2, wherein the stiffener has a threaded portion that is received by a corresponding threaded portion of the housing.

6. The cable bolt of claim 1, wherein an exterior surface of the housing defines an annular groove.

7. The cable bolt of claim 1, wherein the nut comprises a body having a flange extending radially outward from the body, the passageway of the nut extending through the body.

8. The cable bolt of claim 7, wherein the nut includes a threaded portion positioned within the passageway of the nut.

9. The cable bolt of claim 2, further comprising a ring that is positioned over the stiffener and the cable, the ring secured to the second end of the housing and defining an annular groove, the annular groove of the ring receiving an o-ring that engages the stiffener.

10. The cable bolt of claim 2, further comprising a washer and a tube positioned over the stiffener and the cable, the washer and the tube configured to restrict the flow of grout within a borehole upon installation.

11. The cable bolt of claim 2, further comprising an expansion assembly having expansion anchors and an expansion plug, the expansion assembly received on a threaded portion of the stiffener.

12. The cable bolt of claim 10, further comprising a bearing plate positioned between the barrel and wedge assembly and the tube.

13. The cable bolt of claim 11, further comprising:

a washer and a tube positioned over the stiffener and the cable, the washer and the tube configured to restrict the flow of grout within a borehole upon installation; and a bearing plate positioned between the barrel and wedge assembly and the tube.

14. A method of installing a cable bolt comprising:

inserting a cable bolt into a borehole, the cable bolt comprising a multi-strand cable, a barrel and wedge assembly, and a nut defining a passageway, the multi-strand cable having a first end and a second end and defining a plurality of gaps between strands of the cable, the nut positioned adjacent to the first end of the multi-strand cable, the barrel and wedge assembly positioned between the nut and the second end of the multi-strand cable; and after inserting the cable bolt into the borehole, delivering grout to the borehole by initially flowing grout through the passageway of the nut, then through each of the plurality of gaps between the strands of the cable at the first end of the cable, then into the borehole, and then to the second end of the cable.

15. The method of claim 14, further comprising:

rotating the cable bolt to expand an expansion assembly provided on the cable bolt such that the expansion assembly engages rock strata adjacent to the borehole.

16. The method of claim 14, wherein the grout comprises polyurethane resin.

17. The method of claim 14, further comprising:

injecting the grout into cracks in rock strata that are adjacent to the borehole.

18. The method of claim 17, wherein the grout is delivered at a pressure of at least about 4,000 psi.

19. The method of claim 17, wherein the grout comprises polyurethane resin.

20. The cable bolt of claim 1, wherein an exterior surface of the nut is polygonal.

21. The cable bolt of claim 1, wherein the multi-strand cable further comprises a solid central wire.

* * * * *